US008038003B2

(12) United States Patent
Rometty et al.

(10) Patent No.: US 8,038,003 B2
(45) **Date of Patent: *Oct. 18, 2011**

(54) HEAVY DUTY HANDLE U-BOARD

(75) Inventors: John A. Rometty, Barrington, IL (US); Jeffrey W. O'Hara, Cherry Valley, IL (US)

(73) Assignee: Illinois Tool Works Inc., Glenview, IL (US)

( * ) Notice: Subject to any disclaimer, the term of this patent is extended or adjusted under 35 U.S.C. 154(b) by 251 days.

This patent is subject to a terminal disclaimer.

(21) Appl. No.: 11/845,381

(22) Filed: Aug. 27, 2007

(65) Prior Publication Data

US 2009/0057383 A1 Mar. 5, 2009

(51) Int. Cl.
*B65D 85/46* (2006.01)
*B65D 81/02* (2006.01)

(52) U.S. Cl. ..... 206/325; 206/453; 206/586; 229/930

(58) Field of Classification Search ..... 206/321, 206/325, 453, 586, 591; 248/345.1; 428/122–125, 428/182, 188; 229/930–931

See application file for complete search history.

(56) References Cited

U.S. PATENT DOCUMENTS

| | | | | |
|---|---|---|---|---|
| 2,575,898 | A * | 11/1951 | Tadinger | 428/182 |
| 3,425,544 | A * | 2/1969 | Ayer et al. | 229/164 |
| 4,898,279 | A * | 2/1990 | Linnemann | 206/586 |
| 5,431,985 | A * | 7/1995 | Schilling | 428/182 |
| 5,947,290 | A * | 9/1999 | Loeschen | 206/453 |
| 6,527,119 | B1 * | 3/2003 | Markert et al. | 206/453 |
| 6,530,480 | B1 * | 3/2003 | Hardy | 206/586 |
| 6,794,018 | B2 * | 9/2004 | Clark | 206/453 |
| 7,661,579 | B2 * | 2/2010 | Kruelle et al. | 229/930 |
| 2005/0087663 | A1 * | 4/2005 | Schroeder | 248/345.1 |

* cited by examiner

*Primary Examiner* — Bryon Gehman
(74) *Attorney, Agent, or Firm* — Levenfeld Pearlstein, LLC

(57) ABSTRACT

A packaging container has a heavy duty integrated handle. The container is formed from a rigid unit of generally U-shaped cross-section having a main body portion with a generally flat bottom wall and upstanding, opposing sidewalls, wherein the bottom wall is reinforced with reinforcing material. Reinforced hand openings are formed in the reinforced bottom wall, configured for a user to insert a hand for use as the handle for the packaging container.

5 Claims, 1 Drawing Sheet

HEAVY DUTY HANDLE U-BOARD

BACKGROUND OF THE INVENTION

The present invention is directed to a packaging container. More particularly, the present invention pertains to a packaging container formed from a reinforced U-board having a heavy duty integrated handle.

U-shaped material, or U-board, is a known packaging material for many objects. The material is formed from a layered construction (a lamination) of paper and/or paper board that is formed into a U-shape (U-shaped cross-section). The U-board is rigid. That is, the walls are rigidly formed into the U-shape (the walls are formed transverse relative to the base) and are rigid longitudinally along the length of the U-board. The walls typically do not fold down onto the base, nor can the U-board be folded, length-wise onto itself.

U-board is used for a wide variety of commonly packaged items. It can be used to package long, fragile items and in a common use, U-board is used for packaging doors and windows to protect the edges of items from bumping, dropping or general handling.

While U-board has been used with a great deal of success for packaging such items, in order to carry or otherwise handle the U-board, it has been found that handles or grasping members are required to supplement the U-board. In large measure, such handles have been attached to the U-board to carry the items surrounded by the U-board. Handles that are presently used are made from paperboard-type materials, wood, metal or some combination of these materials. Handles can be strapped or taped to the U-board. The strapping or taping requires time and additional materials and on occasion, although seldom, the handles can be pulled from the package.

Accordingly, there is a need for a heavy-duty integrated handle for U-board packaging. Desirably, such a handle minimizes the amount of additional materials and cost, needed to form or create the handle. More desirably, such a handle is readily made and usable, and has a high degree of integrity.

BRIEF SUMMARY OF THE INVENTION

A packaging container having a heavy duty integrated handle is formed from a preformed, rigid unit of generally U-shaped cross-section having a main body portion with a generally flat, reinforced bottom wall and upstanding, opposing side walls forming a channel.

The packaging container has a reinforced bottom wall fashioned from alternating wide strips of paper and/or paper board with narrower strips of a reinforcing material. Handles are formed as hand openings in the reinforced bottom wall. Build-up of reinforcing material at the bottom wall increases the strength, not only of the bottom wall, but also of the handle openings formed in the bottom wall of the packaging container.

The packaging container of the present invention may be foldable at two regions to define a three-sided container, such as for surrounding a window or door, wherein hand openings are formed in each of the sides. Each side can include a single opening or multiple openings for handles.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
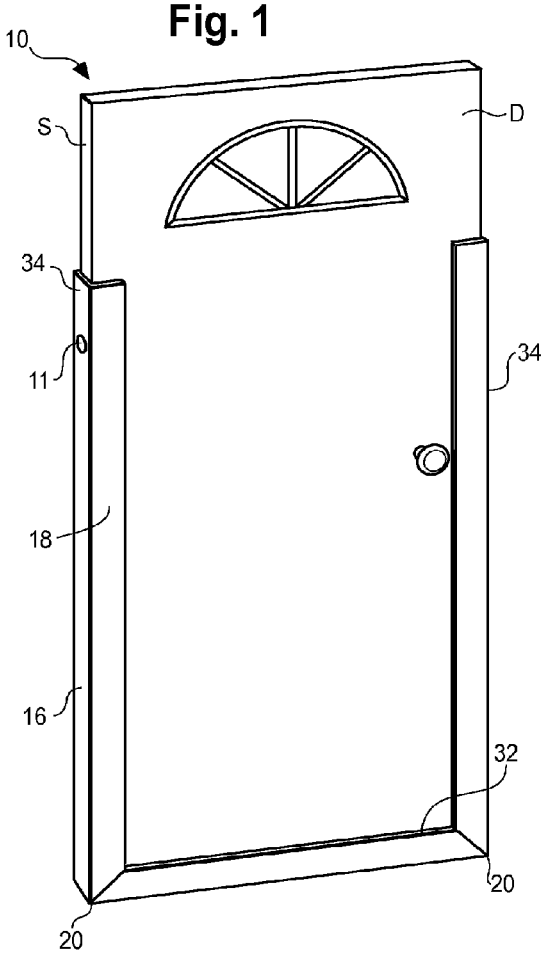
FIG. 1 is a perspective view of a U-shaped packaging container with heavy duty integrated handled embodying the principles of the present invention, the container shown surrounding a door.
Figure 2:
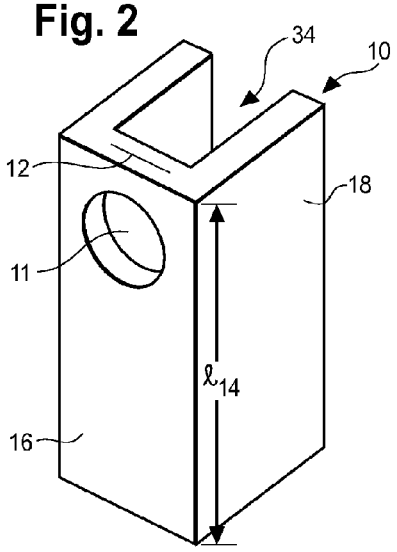
FIG. 2 is a perspective view of a length of the U-shaped packaging container.
Figure 3:
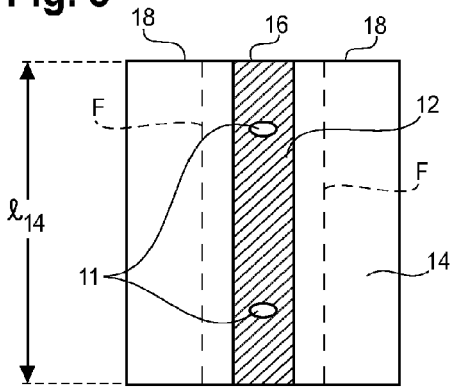
FIG. 3 is a top view of the packaging container of FIG. 2 in a flat state, prior to folding into a U-shape.
Figure 4:
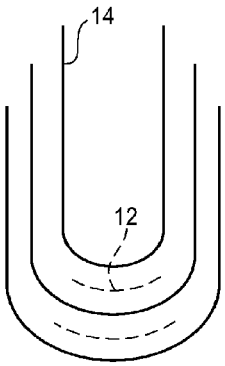
FIG. 4 is an enlarged cross-sectional view of the container of FIG. 2, illustrating the U-shaped cross-section with reinforcement of the bottom wall.
Figure 5:
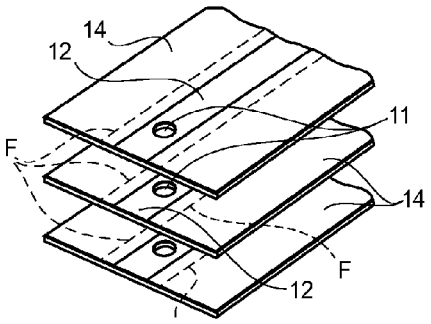
FIG. 5 is a perspective view of the container shown in FIG. 3 with plies of container material alternating with plies of reinforcing material.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a packaging container (or U-board) 10 having a heavy duty integrated handle 11 embodying the principles of the present invention. The U-board 10 is configured to support and protect an object, such as the illustrated door D. The U-board 10 is formed from a reinforced U-board: a rigid, U-shaped member, much like a structural channel member, having an opening for a heavy duty handle 11 in the side channel 34.

For purposes of the present disclosure, the package material, although defined as having a U-shaped cross-section is, in fact, formed from a material having a channel-like or squared U-shape having a flat or near-flat (e.g., planar) bottom wall 16 and straight (e.g., generally planar) upstanding side walls 18. The corners 20 are typically formed having a radius of curvature (i.e., rounded); however, they may be formed having relatively sharp angles.

Preferably, the reinforced U-board 10 is formed in a layered construction (e.g., a lamination) of paper and/or paper board container materials 14 and reinforcing material 12. The U-board 10 is rigid, and accordingly, the walls 16, 18 are rigidly formed into the U-shape and are also rigid longitudinally along the length $l_{14}$ of the U-board 10. The walls 18 do not fold down onto the bottom 16, nor can the U-board 10 be readily folded, length-wise onto itself.

The present invention includes the formation of heavy duty reinforced handles 11 integrated with the U-board 10. Handles 11 are formed as hand openings in the bottom wall 16 of the reinforced U-board 10. The handle 11 is formed by cutting an opening for the handle 11 into the bottom wall 16 of the reinforced U-board 10 to define a region for a user to insert a hand. The handle 11 can be any of a variety of shapes, preferably an oval or elliptical shaped opening, with relatively straight sides and rounded corners for its ease in cutting (or forming) in the bottom wall 16 of the U-board 10 and for ease of handling the U-board 10. Other shapes of handle 11 are also contemplated. Regardless of the shape, the handle 11 is sized to permit the user to insert a hand (fingers up to about the hand-finger joint) into the handle 11 to grasp the U-board 10 to move or carry the package D.

Strengthening of the handle 11 occurs by the lamination of strips of a reinforcing material 12 in alternating fashion between strips of paper and/or paper board container material 14 that form the base 16 of the U-board 10. The reinforcing material 12 may or may not be comprised of the same material 14 forming the base 16 and the walls 18 of the U-channels 32, 34. In addition, the reinforcing material 12 need not extend across the entire width of the base 16; the width of the reinforcing material 12 is at least as wide as the handle 11 to be formed and is preferably slightly wider than the handle 11. It is anticipated, however, that reinforcing material 12 may be narrower than the width of the handle 11.

To manufacture an embodiment of an heavy duty handle U-board, one or more narrow strips of reinforcing material 12 is centered on the top of one or more strips of wider container material 14, with an adhesive means placed between the two layers 12, 14. A strip or strips of container material 14 is centered on top of the previously laid narrower reinforcing strips 12, again with an adhesive means adhering the layers together. This alternating layered sequence is repeated until a sufficiently rigid board 10 is fashioned. Specifically, build-up of reinforcing material 12 in the center of the flattened board strengthens the base 16 of the folded U-board 10.

In a commonly used method, the laminations and adhesive are made in a wet environment (a wet adhesive), the walls 18 are then folded up from the base 16 and allowed to dry. The result is the rigid U-shape illustrated. Prior to the reinforced board 10 drying, the board 10 is bent or folded along fold lines F, such that the board 10 is molded into a channel 22 in the shape of a "U," with a base 16, and sidewalls 18. The molded U-board 10 dries to form a rigid, U-board 10. It is understood that the layers of material 12, 14 can be sequenced in various ways, but that a preferred method sequences the materials 12, 14 such that the container material 14 forms both the bottom and the top layer of the flattened U-board 10. Handles 11 are formed in the overlapping layers of materials 12, 14 of the reinforced base 16 prior to or after folding of the U-board 10.

Because the handle 11 is formed in the reinforced base area 16 of U-board 10, the strength of the handle 11 is advantageously increased. The handles 11 are formed in the bottom wall 16 only and extend across less than an entire width of the bottom wall 16 so as to not extend into the side walls 18. This increases assurance of the integrity of the handle 11 system; it does so while reducing the overall number of parts (e.g., handles, etc.) needed to form a holding element for the U-board 10.

The handles 11 can be cut into the material 10 as the U-board 10 is cut to fit the item D (e.g., the window or door). It is also anticipated that U-boards 10 can be formed with a plurality of openings 11 pre-formed in the bottom wall 16 at predetermined intervals or distances to provide a standardized packaging material 10 for windows, doors and the like.

One use of the heavy duty handle U-board is shown in FIG. 1 where the U-board 10 is folded about the cross-section to wrap around an item such as a door, D. The foldable regions are defined by cuts in the side walls 18. The U-board 10 can then be positioned around the particular item D and the item can be wrapped or strapped (as needed) to protect the item D. It will be appreciated that in use, the U-board 10 is cut at the corners 20 and the item D is positioned in the base channel 32. The side channel elements 34 are folded up along the sides S of the item D with the handles 11 disposed in the side channels 34.

It will be appreciated that while the board container material 14 is typically a paper or paperboard-based material, the reinforcing material 12 can be a paper or paperboard-based material, a polymeric material (such as high-density polyethylene (HDPE), low density polyethylene (LDPE) or the like), or any other suitable material that can be inserted between the container material 14 layers in the desired formation (e.g., wet adhesive) process to provide the enhanced strength.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A heavy duty handle U-board comprising:

a packaging container having a plurality of first strips formed of paper or paperboard material each having a first width and a plurality of second strips formed of paper or paper-board material, the second strips being reinforcing strips, the second strips each having a second width, the width of the second strips being less than the width of the first strips, the plurality of first strips and the plurality of second strips having a length, wherein each of the second strips is disposed in an alternating manner between two of the first strips, wherein the plurality of first strips and the plurality of second strips are laminated and molded into a rigid U-shape channel having a first side wall and a second side wall and a bottom wall, a first corner between the first sidewall and the bottom wall, and a second corner between the second side wall and the bottom wall, the corners being rounded, and wherein the first side wall and the second side wall are not foldable onto the bottom wall, the second strips extending across the base but not into the first and second corners; and two openings formed in overlapping portions of, and through the first strips and the second strips, in the bottom wall, the two openings configured to form two respective handles in the packaging container, wherein the second strips reinforce the openings.

2. The heavy duty handle U-board of claim 1 wherein the second strips are centered within the first width of each of the first strips.

3. The heavy duty handle U-board of claim 1 wherein the two openings are oval.

4. The heavy duty handle U-board of claim 1 wherein the two openings are non-oval.

5. A method for forming a heavy duty handle board, comprising the steps of:

providing a plurality of first strips each having a first width;

providing a plurality of second strips each having a second width, the second strips being reinforcing strips;

layering the second strips between two of the first strips in an alternating manner;

centering the second strips within the first width of two of the first strips;

laminating the first strips and the second strips to form a board;

molding the lamination of the first strips and the second strips into a rigid, generally U-shape unit having a first sidewall, a second sidewall, and a bottom wall, and defining corners at junctures of the first and second side walls and the bottom wall, the first sidewall and the second sidewall extend upwardly from the base, and wherein the first sidewall and the second sidewall are not foldable onto the bottom wall, and wherein the second strips extend across the bottom wall but not into the corners;

forming at least two openings in the bottom wall, through overlapping portions of, and through the first strips and the second strips, wherein the second width of the second strips is different from the first width of the first strips, and wherein the second strips reinforce the openings; and folding the unit to form a base channel and a first side channel and a second side channel, wherein the base channel is disposed between the first side channel and the second side channel, the first and the second side channels extending upwardly therefrom, and wherein the openings are disposed in the first side channel and the second side channel, respectively.

* * * * *